United States Patent [19]

Tanaka et al.

[11] Patent Number: 4,818,376

[45] Date of Patent: Apr. 4, 1989

[54] LEAKAGE PREVENTION APPARATUS FOR A CLASSIFIER

[75] Inventors: Hiroaki Tanaka, Narashino; Mitsuhiro Ito, Funabashi; Takeshi Furukawa; Satoru Fujii, both of Onoda, all of Japan

[73] Assignee: Onoda Cement Company, Ltd., Onoda, Japan

[21] Appl. No.: 42,438

[22] Filed: Apr. 24, 1987

[30] Foreign Application Priority Data

Apr. 28, 1986 [JP] Japan ..... 61-63269[U]
Apr. 28, 1986 [JP] Japan ..... 61-63270[U]

[51] Int. Cl.[4] ..... B07B 4/02; B07B 7/00; B07B 11/06

[52] U.S. Cl. ..... 209/135; 209/144; 209/148; 209/154

[58] Field of Search ..... 209/144, 145, 148, 154, 209/134, 135; 55/406, 408

[56] References Cited

U.S. PATENT DOCUMENTS

| | | | |
|---|---|---|---|
| 2,790,550 | 4/1957 | Doyle et al. | 209/144 |
| 3,237,766 | 3/1966 | Humphreys | 209/144 X |
| 4,296,864 | 10/1981 | Misaka et al. | 209/148 X |
| 4,551,241 | 11/1985 | Saverse et al. | 209/144 X |
| 4,626,343 | 12/1986 | Folsberg | 209/154 X |

FOREIGN PATENT DOCUMENTS

| | | | |
|---|---|---|---|
| 3425101 | 1/1986 | Fed. Rep. of Germany | 209/154 |
| 0829211 | 5/1981 | U.S.S.R. | 209/145 |

*Primary Examiner*—Robert B. Reeves
*Assistant Examiner*—Edward M. Wacyra
*Attorney, Agent, or Firm*—Tilton, Fallon, Lungmus & Chestnut

[57] ABSTRACT

In a classifier including a rotary disc provided on a lower end of a vertical rotary shaft depending from the top of a hopper-type casing, a horizontal dispersing disc is provided directly below the top of the casing, a circular collision plate is spaced from the outer circumference of the horizontal dispersing disc, and a plurality of vortex adjusting members are secured at their upper ends to the horizontal dispersing disc and at their lower ends to the rotary disc, and a leakage prevention apparatus is provided which comprises a plurality of dispersing and classifying vanes spaced from the outside of the vortex adjusting members and the inner sides of the collision plate. The dispersing and classifying vanes depend from the under surface of the horizontal dispersing disc for an appropriate length. Furthermore, the leakage prevention apparatus can also comprise a ring for preventing the introduction of coarse powder which is provided on the outer circumference of the horizontal dispersing disc, the ring depending from the under surface of such horizontal dispersing disc for an appropriate length.

7 Claims, 4 Drawing Sheets

LEAKAGE PREVENTION APPARATUS FOR A CLASSIFIER

BACKGROUND OF THE INVENTION

This invention relates to an apparatus for preventing a leakage of a portion of a coarse powder into a fine powder side in a classifier for classifying raw material into fine powder and coarse powder.

It is well known for a classifier to have a plurality of rotating vortex adjusting members and a plurality of fixed guide vanes at the outside of the vortex adjusting members in a casing in which a raw material is classified into a coarse powder and a fine powder, to flow and pass the fine powder through a classifying chamber together with the air flow and to discharge and collect the classified powder at the outside of the machine casing by introducing the raw material into the air flow which forms the free vortex at first and then turns into the forced vortex.

However, in such prior classifiers, although the raw material charged into the machine casing from a raw material inlet would be dispersed by the rotation of the horizontal dispersing disc, there still resides the problem in which the non-classified powder not yet sufficiently dispersed by such rotation is mixed into and discharged with the fine powder by being carried on the air flowing into the interior of the classifying chamber, when it doesn't reach appropriate tangential speed and as a result the phenomenon of coarse particles being mixed in with the fine particle portion, that is the phenomenon of the coarse particles leaking into the fine particles can be seen.

SUMMARY OF THE INVENTION

Therefore, the object of the invention is to provide a leakage prevention apparatus for a classifier where, in order to resolve the above-mentioned problems in the prior art the classified raw material supplied from the upper portion is quickly dispersed and classified into the coarse particle portion and a fine particle portion and the neccessary tangential speed is also applied to the non-classified powder to prevent the admixture of the coarse particles within the fine particles.

Another object of the invention is to provide a leakage prevention apparatus for a classifier for preventing the admixture of the non-classified powder which has not reached the necessary tangential speed into the fine powder.

According to a first embodiment of the invention, in a classifier comprising a hopper-typed casing having a substantially cylindrical upper portion and a substantially cone-shaped lower portion, a vertical rotary shaft depending from the center of the casing, a rotary disc disposed in the vicinity of a lower end of the cylindrical portion of the casing and mounted on the end of the vertical rotary shaft, a horizontal dispersing disc provided directly below the top of the casing, a plurality of vertical guide vanes provided spaced from the outside of the horizontal dispersing disc and inwardly spaced from one or a plurality of air inlets extended tangentially to the surface of the cylindrical portion of the casing to form a classifying chamber with the rotary disc and the horizontal dispersing disc, a circular collision plate spaced from the outside of the horizontal dispersing disc in the upper portion of the classifying chamber, a plurality of vortex adjusting members provided on the same circumference in the classifying chamber and secured at their one ends to the rotary disc and at their other ends to the horizontal dispersing disc, and a fine powder discharge pipe provided on the upper portion of the casing to communicate into the inner side of the vortex adjusting members in the classifying chamber, the classifier having a leakage prevention apparatus characterized by a plurality of dispersing and classifying vanes spaced from the outside of the vortex adjusting members and inwardly spaced from the collision plate and having their upper ends secured on the under surface of the horizontal dispersing disc.

Furthermore, in accordance with a second embodiment of the invention, in a classifier comprising a hopper-type casing having a substantially cylindrical upper portion and a substantially cone-shaped lower portion, a vertical rotary shaft depending from the center of the casing, a rotary disc disposed in the vicinity of a lower end of the cylindrical portion of the casing and mounted on the end of the vertical rotary shaft, a horizontal dispersing disc provided directly below the top of the casing, a plurality of vertical guide vanes provided spaced from the outside of the horizontal dispersing disc and inwardly spaced from one or a plurality of air inlets extended tangentially to the surface of the portion of the casing to form a classifying chamber with the rotary disc and the horizontal dispersing disc, a circular collision plate spaced from the outside of the horizontal dispersing disc in the upper portion of the classifying chamber, a plurality of vortex adjusting members provided on the same circumference in the classifying chamber and secured at their one ends to the rotary disc and at their other ends to the horizontal dispersing disc, and a fine powder discharge pipe provided on the upper portion of the casing to communicate into the inner side of the vortex adjusting members in the classifying chamber, the classifier having a leakage prevention apparatus characterized by a ring for preventing the introduction of the coarse powder, which is provided coaxially with the rotary shaft on the outer circumference of the horizontal dispersing disc.

The other objects, the features and the advantages of the invention can be clearly understood from the following detailed explanation with reference to the attached drawings for the specific embodiments of the invention in which the same members are used with the same numerals.

DESCRIPTION OF THE DRAWING

The invention will be explained in conjunction with the illustrative embodiments shown in the accompanying drawings, in which.

DESCRIPTION OF PREFERRED EMBODIMENTS OF INVENTION

Figure 1:
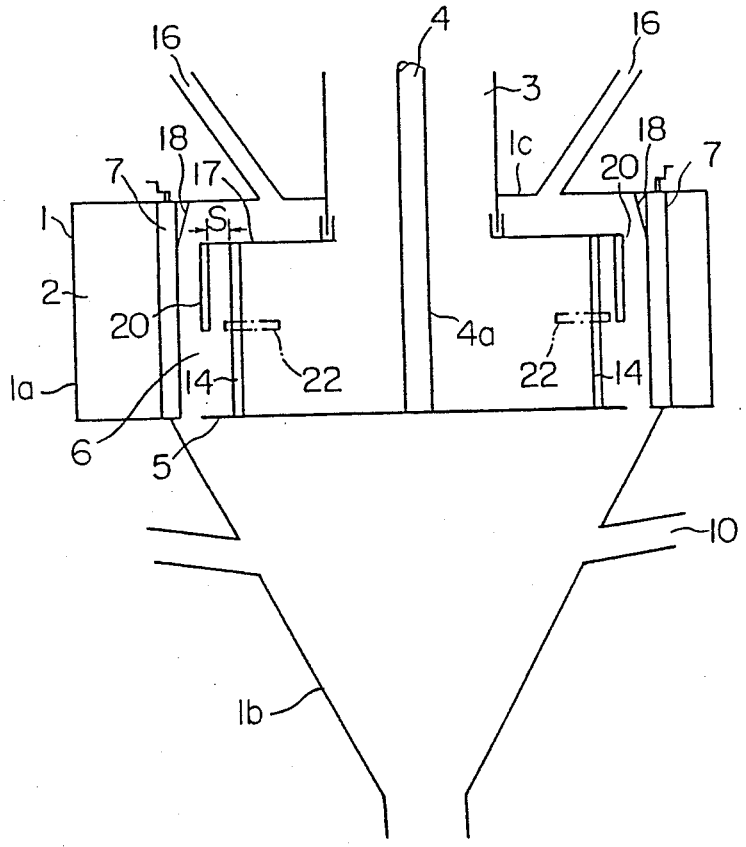
FIG. 1 is a vertical section of a first embodiment of a leakage prevention apparatus for a classifier formed in accordance with the invention.
Figure 2:
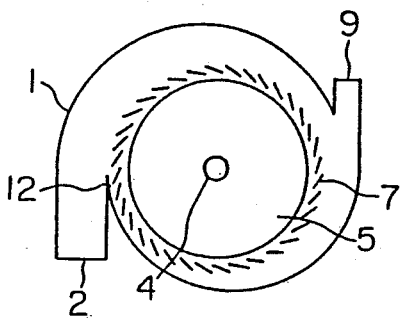
FIG. 2 is a schematically transverse section of the first embodiment in FIG. 1.
Figure 3:
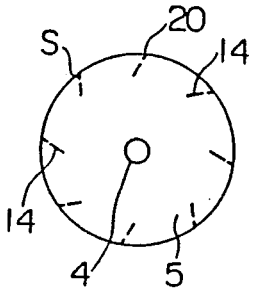
FIGS. 3 to 6 are the transverse sections showing the examples for mounting the vortex adjusting members and the dispersing and classifying vanes in the first embodiment.
Figure 4:
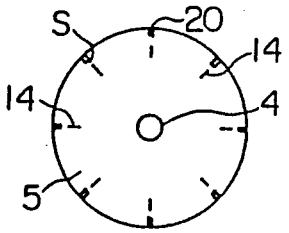
Figure 5:
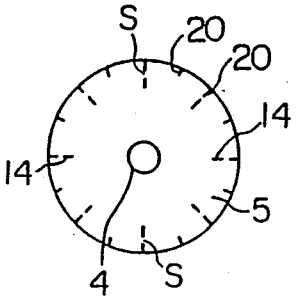

Referring in detail to the figures in the drawings, there is shown diagrammatically in FIGS. 1 and 2 an embodiment of a classifier with a leakage prevention apparatus of the invention having a hopper-type casing 1 with a substantially cylindrical upper portion 1*a* and a substantially cone-shaped lower portion 1*b* which is provided with the tangential air inlets 2 and 9 on the cylindrical side portion of the casing 1, a raw material inlet 16 on the top 1*c* of the casing 1 and a vertical rotary shaft 4 at the center of the casing 1. At the lower end 4*a* of the rotary shaft 4 a rotary disc 5 is provided in the vicinity of the lower end of the cylindrical portion 1*a* of the casing 1, and a horizontal dispersing disc 17 is provided substantially above the rotary disc 5 spaced from and directly below the top 1*c* of the casing 1 to rotate unitarily with the vertical rotary shaft 4 at a position where the raw material falls from the material inlet 16. Also, a plurality of vertical guide vanes 7 are disposed at a certain angle to the inner circumference of the casing 1 at a position spaced inner than the air inlets 2 and 9 in the casing 1 but out of the space formed directly below the horizontal dispersing disc 17, these vertical guide vanes 7, the rotary disc 5 and the horizontal dispersing disc 17 forming a classifying chamber 6, and also an annular collision plate 18 is provided at a position spaced from the outer side of the horizontal dispersing disc 17 above the classifying chamber 6 coaxially with the vertical rotary shaft 4 so that an annular space is formed for having the raw material flow from the circular space between the collision plate 18 and the horizontal dispersing disc 17 into the classifying chamber 6. A plurality of vortex adjusting members 14 are provided between the rotary disc 5 and the horizontal dispersing disc 17 in the classifying chamber 6 with one end of each vortex adjusting member 14 being secured on the rotary disc 5 and other end thereof being secured on the dispersing disc 17 and disposed along the smme circumference centered on the vertical shaft 4. A discharge pipe 3 for fine powder is provided above the casing 1 to communicate the inner portion of the classifying chamber 6 which is inwards from the vortex adjusting member 14, and the hopper portion 1*b* adjacent with the casing 1 serves as a coarse powder collecting portion for discharging the powder by a rotary feeder (not shown), and a third air inlet 10 is provided on the hopper portion 1*b* of the casing 1 to assist the reclassification of the coarse powder.

As shown in the drawings, a plurality of dispersing and classifying vanes 20 are provided outside of the vortex adjusting members 14, and one end of each vane 20 is secured to hang from the underside of the dispersing disc 17 and coaxially spaced from the rotary shaft 4 within the casing 1. The length of each dispersing and classifying vane 20 is more than one-tenth of the length of the vortex adjusting member 14, but less than the length thereof, and the width thereof is desirably substantially the same as that of the adjusting members 14 to create a space S between the vortex adjusting members 14 and the dispersing and classifying vanes 20.

If it is desirable to divide the flow into the classifying chamber 6 into several portions, one or more separating annular plates 22 can be provided between the rotary disc 5 and the horizontal dispersing disc 17 as shown by the dotted chain line in FIG. 1.

Figure 6:
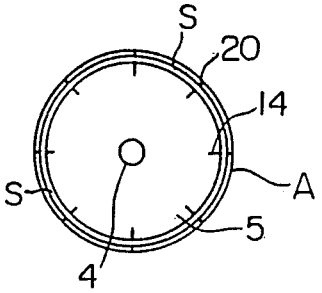

In FIGS. 3 to 6, examples of various arrangements of the dispersing and classifying vanes 20 are shown. In the examples shown in FIGS. 3 and 4, the dispersing and classifying vanes 20 are mounted outside of and in correspondence with the position of mounting of the vortex adjusting members 14 with the space S left therebetween, while in FIG. 5 the dispersing and classifying vanes 20 are likewise mounted outside of the vortex adjusting members 14 but alternately with the circumferential positions of the vortex adjusting members 14. In FIG. 6, the free ends of the dispersing and classifying vanes 20 are secured on a ring A to form the annular space S between the vortex adjusting members 14. Moreover, the classifying and dispersing vanes 20 can be mounted in a manner not described in the figures without deviating from the subject matters of the present invention.

The operation and effect of the classifier having the leakage prevention apparatus according to the present invention is as follows:

The raw material charged into the material inlet 16 of the classifier falls on the horizontal dispersing disc 17, is dispersed by the rotation of the dispersing disc 17, collides with the collision plate 18 to change the direction of the material and is introduced into the air flow from the air inlet 2 or the air inlets 2 and 9 and made to flow from the inner circumference of the casing 1 into the classifying chamber 6 by the formed vortex of the air.

The raw material flowing into the classifying chamber 6 is simultaneously effected by two opposite forces, the outward centrifugal force from the rotating air flow intensified by the vortex adjusting members 14 mounted on the rotary disc 5 and the radially inwardly effected air resistance. In this, the radially inwardly effected air resistance is greater than the outward centrifugal force on the fine powder so that the fine powder is carried on the air flow to move inwardly into the fine powder discharge pipe 3 to be collected by a collecting device (not shown) provided separately. On the other hand, the centrifugal force is greater than the inward air resistance on the coarse powder so that it flows along the inner side of the guide vanes 7 to arrive at the coarse powder pocket 12 to fall rapidly into the cone-shaped hopper 1*b* of the casing 1, to be discharged to the outside. Furthermore, the raw material can be introduced from the air inlets 2 and/or 9 together with from the material inlet 16 or instead of from the material inlet 16.

With regard to the non-classified powder particles that did not reach proper tangential speed and were carried on the inner air flow, the dispersing and classifying vanes 20 are provided, in the present invention, in the upper portion of the classifying chamber 6 where a great number of such particles exist, so that the non-classified powder is sufficiently dispersed in this portion and is supplied with the proper tangential speed. Furthermore, the raw material passing through the gap S between the vortex adjusting members 14 and the dispersing and classifying vanes 20 is subjected to a considerable amount of flow resistance generated by an air layer by their rotation. From all of these, the amount of non-classified powder strayed into the fine powder in the classifying chamber 6 becomes extremely small.

By the sufficiently lengthening the dispersing and classifying vanes 20, the above classification can be satisfactorily effected, but if they are lengthened too much, a greater volume of classifying air becomes necessary, causing the increase of the consumption of electric power. Also, since insufficiently dispersed non-classified powder is concentrated in the upper most portion of the classifying chamber 6, it is preferable for dispersing and classifying vanes 20 to be mounted substantially at the upper portion of the classifying chamber 6.

According to experiments, it is preferable that the length of the dispersing and classifying vanes 20 be in the range from one-tenth to the same length of the vortex adjusting members 14, in particular in the range of one-fourth to one half of the length of the vortex adjusting members. If the upper ends of the dispersing and classifying vanes 20 are secured on the under surface of the horizontal dispersing disc 17, the lower ends of the dispersing and classifying vanes 20 can be free in accordance with their length or can be secured on another ring A provided coaxially with the vertical rotary shaft 4 (FIG. 6).

However, it is necessary to have the annular space S open vertically having a width allowing particles slightly coarser than the size of classification to fall smoothly between such ring A and the rotary disc 5 to which the lower ends of the vortex adjusting members 14 are secured.

With such arrangement of the dispersing and classifying vanes 20 the raw material is sufficiently dispersed into the fine powder and the coarse powder, the non-classified powder portion has a tangential speed within a short period, the fine powder and the coarse powder are separated perfectly, the introduction of the coarse powder into the fine powder portion is almost perfectly prevented, and thus the problem of the coarse powder leaking into the fine powder is resolved.

An example of using a classifier provided with the leakage prevention apparatus of the present invention is shown below.

Calcium carbonate powder dry ground and discharged from a mill was used as a raw material.

The evaluation of the classification results were made by the comprison of the amount of JIS 44 μm sieve residue % of fine powder after classification.

Comparison before and after mounting dispersing classifying vanes

| | Residue % on JIS 44 μm Sieve | |
|---|---|---|
| | raw material | fine powder |
| Before mounting dispersing & classifying vanes | 21.00 | 0.0362 |
| After mounting dispersing & classifying vanes | 21.00 | 0.0025 |

As seen above, in accordance with the leakage prevention apparatus for a classifier of the present invention, by provision of the dispersing and classifying vanes spaced outside of the vortex adjusting members, the raw material is sufficiently dispersed into fine powder and coarse powder, and has a suitable tangential speed within a short period and is separated perfectly into fine powder and coarse powder. Furthermore, between the vortex adjusting members and the dispersing and classifying vanes a space is formed, an air layer is therefore created in this space by the rotation of both these vanes at the same speed, which perfectly prevents the leakage of the coarse powder by the effective use of the differential pressure between the inner and outer portions of the air layer, resulting in the improvement of the classification accuracy in the classifier.

Figure 7:
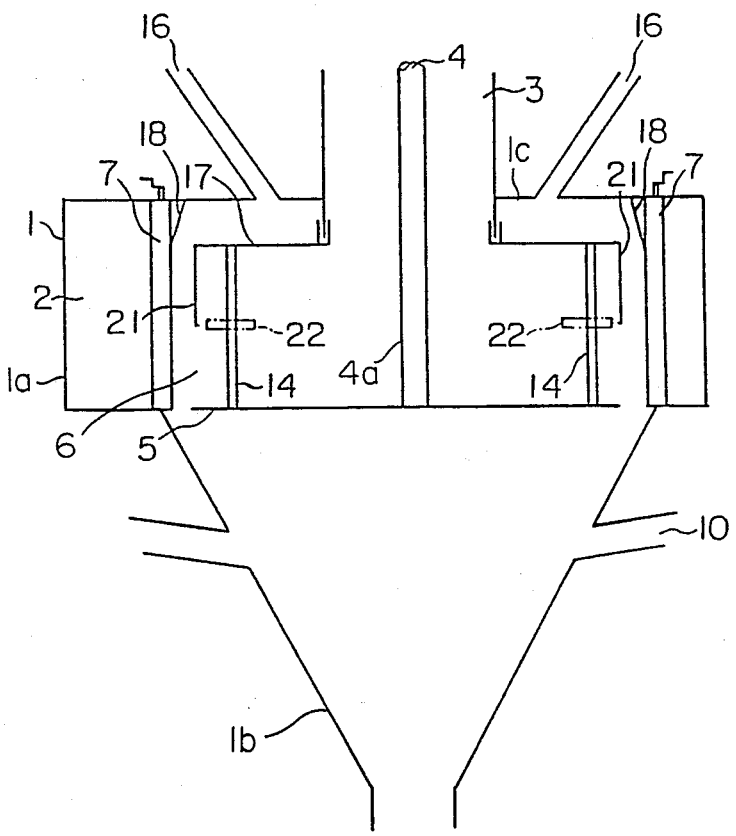
FIG. 7 is a vertical section of a second embodiment of the leakage prevention apparatus for the classifier.
Figure 8:
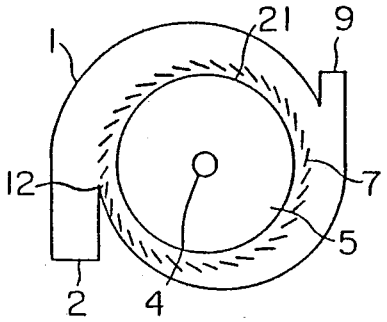
FIG. 8 is a schematically transverse section of the second embodiment in FIG. 7.
Figure 9:
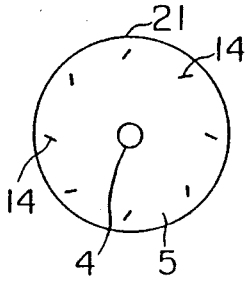
FIGS. 9 to 11 are the transverse sections showing examples for mounting the vortex adjusting members and the introduction of preventing rings in the second embodiment.
Figure 10:
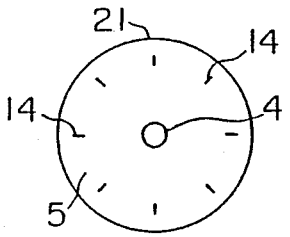
Figure 11:
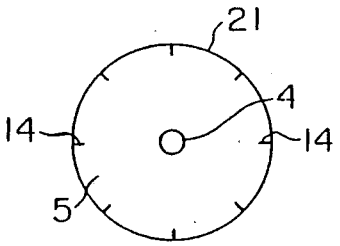

In FIGS. 7 and 8, there is shown a second embodiment of the leakage prevention apparatus for the classifier in accordance with the present invention. This embodiment differs with that of the first embodiment previously mentioned in that a ring 21 for preventing the introduction of coarse powder is provided spaced outwardly from the vortex adjusting members 14, instead of the dispersing and classifying vanes in the first embodiment. This ring 21 is provided on the underside of the horizontal dispersing disc 17 and is constructed to be disposed on the coaxial circumference with the vertical rotary shaft 4 in the casing 1. The length of the ring 21 for preventing the introduction of coarse powder is more than one-tenth of the length of the vortex adjusting member 14 and less than the same length thereof and is provided on the circumference of the horizontal dispersing disc 17. FIGS. 9 to 11 show the examples of the arrangements for mounting the various kinds of the vortex adjusting members 14. As shown in FIG. 7, one or more dividing plates 22 are provided to divide the air flow into the classifying chamber 6 into several portions between the rotary disc 5 and the horizontal dispersing disc 17.

The operation and effect for this second embodiment is substantially the same as that of the first embodiment previously mentioned. The length of the ring 21 is preferably in the range of one-tenth to one half of the length of the vortex adjusting member 14, in particular in the range of one-eighth to one-fourth of the length of the vortex adjusting member 14.

By the provision of such ring 21 for preventing the introduction of coarse powder, a sufficient tangential speed for good classification is imparted to the powder during its fall from the upper portion of the classifying chamber, whereby the fine powder and the coarse powder are completely separated and the introduction of the coarse powder into the fine powder portion is almost completely prevented to perfectly resolve the problem of the leakage of the coarse powder into the fine powder.

While in the foregoing description, the specific embodiments of the invention have been set forth in detail, it can be understood that many details given herein may be considerably varied by those skilled in the art without departing from the spirit and scope of the invention.

What is claimed is:

1. In a classifier comprising a hopper-typed casing having a substantially cylindrical upper portion and a substantially cone-shaped lower portion, a vertical rotary shaft depending from the center of the casing, a rotary disc disposed in the vicinity of the lower end of the cylindrical portion of the casing and mounted on the end of the vertical rotary shaft, a horizontal dispersing disc provided directly below the top of the casing, a plurality of vertical guide vanes provided spaced from the outside of the horizontal dispersing disc and inwardly spaced from one or a plurality of air inlets extended tangentially to the cylindrical portion of the casing to form a classifying chamber with the rotary disc and the horizontal dispersing disc, a circular collision plate spaced from the outside of the horizontal dispersing disc in the upper portion of the classifying chamber, a plurality of vortex adjusting members provided on the same circumference in the classifying chamber and secured at their one ends to the rotary disc and at their other ends to the horizontal dispersing disc, and a fine powder discharge pipe provided on the upper portion of the casing to communicate into the inner side of the vortex adjusting members in the classifying chamber; the classifier having a leakage prevention apparatus characterized by a plurality of dispersing and classifying vanes spaced from the outside of the vortex adjusting members and inwardly spaced from the collision plate and having their upper ends secured on the under surface of the horizontal dispersing disc.

2. The leakage prevention apparatus of claim 1 in which each of said dispersing and classifying vanes depends from the under surface of the horizontal dispersing disc and has an opposite free end.

3. The leakage prevention apparatus of claim 1 in which the length of each of said dispersing and classifying vanes is in the range of one-tenth to the same length of the vortex adjusting member, preferably in the range of one-fourth to one-half of the length of the vortex adjusting member.

4. The leakage prevention apparatus of claim 1 in which the width of each of said dispersing and classifying vanes is substantially the same width as the vortex adjusting member.

5. In a classifier comprising a hopper-typed casing having a substantially cylindrical upper portion and a substantially cone-shaped lower portion, a vertical rotary shaft depending from the center of the casing, a rotary disc disposed in the vicinity of a lower end of the cylindrical portion of the casing and mounted on the end of the vertical rotary shaft, a raw material inlet 16 on the top of the casing, a horizontal dispersing disc provided directly below the top of the casing, a plurality of vertical guide vanes provided spaced from the outside of the horizontal dispersing disc and inwardly spaced from one or a plurality of air inlets extended tangentially to the cylindrical portion of the casing to form a classifying chamber with the rotary disc and the horizontal dispersing disc, a circular collision plate spaced from the outside of the horizontal dispersing disc in the upper portion of the classifying chamber, a plurality of vortex adjusting members provided on the same circumference in the classifying chamber and secured at their one ends to the rotary disc and at their other ends to the horizontal dispersing disc, and a fine powder discharge pipe provided on the upper portion of the casing to communicate into the inner side of the vortex adjusting members in the classifying chamber; the classifier having a leakage prevention apparatus characterized by a ring for preventing the introduction of the coarse powder into fine powder provided coaxially with the rotary shaft on the outer circumference of the horizontal dispersing disc.

6. The leakage prevention apparatus of claim 5 in which said ring for preventing the introduction of the coarse powder depends from the under surface of the horizontal dispersing disc and has a lower free edge.

7. The leakage prevention apparatus of claim 5 in which the length of said ring is in the range of one-tenth to one-half of the length of the vortex adjusting member, preferably in the range of one-eighth to one-fourth of the length of the vortex adjusting member.

* * * * *